United States Patent [19]

Nieman

[11] 4,147,837

[45] Apr. 3, 1979

[54] ELONGATE COMPOSITE ARTICLE

[75] Inventor: John R. Nieman, Pekin, Ill.

[73] Assignee: Caterpillar Tractor Co., Peoria, Ill.

[21] Appl. No.: 859,495

[22] Filed: Dec. 12, 1977

[51] Int. Cl.[2] ..... B22F 3/00

[52] U.S. Cl. ..... 428/548; 75/208 CS; 428/528; 428/558; 428/576

[58] Field of Search ..... 428/528, 576, 548, 558; 75/208 CS

[56] References Cited

U.S. PATENT DOCUMENTS

| | | | |
|---|---|---|---|
| 2,320,801 | 6/1943 | Simons | 75/208 CS |
| 2,819,163 | 1/1958 | Balke et al. | 75/214 |
| 3,056,190 | 10/1962 | Chisholm et al. | 29/182.5 |
| 3,088,195 | 5/1963 | Noethlich, Jr. et al. | 75/208 CS |
| 3,226,814 | 1/1966 | Leib et al. | 75/208 CS |
| 3,359,096 | 12/1967 | Jost | 75/208 CS |
| 3,389,455 | 6/1968 | Clark | 29/420 |

*Primary Examiner*—Brooks H. Hunt
*Attorney, Agent, or Firm*—John W. Grant

[57] ABSTRACT

An elongate composite article for treating molten iron has a sintered metal tubular sheath enclosing a core of particulate treating agent.

10 Claims, 1 Drawing Figure

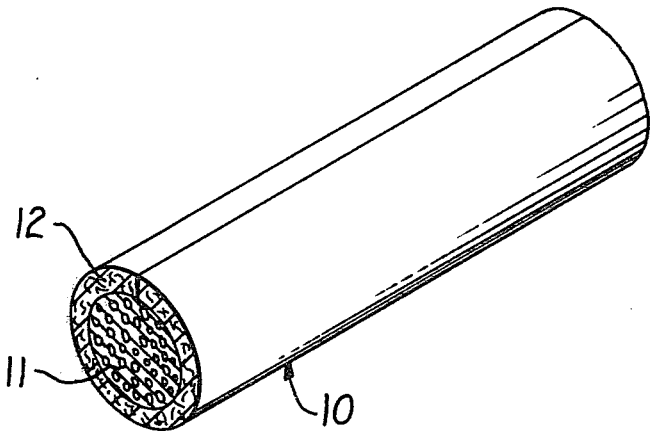
12
11
10

ELONGATE COMPOSITE ARTICLE

BACKGROUND OF THE INVENTION

This invention relates to an elongate composite article for treating molten iron for altering same.

One process for treating molten iron for altering same includes enclosing powered treating agents within a relatively thick-walled metal conduit thereby forming a wire-like article which is inserted into the molten iron at a preselected controlled feed rate. The molten iron dissolves the conduit thereby releasing the treating agent into the molten iron. The conduit is commonly made of steel since steel is highly ductile and does not alter the composition of the molten iron to any significant degree. The wire-like article is normally made by depositing a metered amount of treating agent onto a steel strip, rolling the strip into a tube and enclosing the treating agent, and then drawing the tube down to a smaller size to compact the treating agent and reduce the wall thickness of the tube.

One of the problems encountered with that process of treating molten iron is that the melting point of the steel conduit is higher than the normal pour temperature of the molten iron and the steel conduit is dissolved by the combinations of a solid state diffusion and melting reaction. The time required to dissolve through the relatively thick-walled conduit undesirably delays the final dissolution of the article in the molten iron and also undesirably limits the maximum permissible feed rate of the article into the molten iron.

It is not practical to make the conduit from a cast iron or similar composition of the melt because the ductility of cast iron is low as compared to a low carbon steel. Therefore, a cast iron strip cannot feasibly be rolled into a conduit. Moreover, the use of a conduit having a relatively thin steel wall is not practical since the process commonly used to make the wire-like article leaves a seam. With a thin walled conduit, the seam has a tendency to split open thereby allowing the treating agent to spill out when the article is coiled unto a reel.

SUMMARY OF THE INVENTION

The present invention is directed to overcoming one or more of the problems as set forth above.

According to this invention, an elongate composite article is provided for the introduction of a treating agent into molten iron for altering the molten iron. The article has a metallic sheath made from a sintered metal and which encloses a core of particulate treating agent. The sintered metal sheath has a melting point at a preselected temperature which is about the normal pour temperature of the molten iron and less than the melting temperature of steel.

BRIEF DESCRIPTION OF THE DRAWING

The sole FIGURE is an isometric view partially in section of a composite article of the present invention.

DETAILED DESCRIPTION

Referring to the drawing, an elongate composite article 10 has a core of particulate treating agent 11 and a tubular sheath 12 enclosing the core. The sheath is formulated from a sintered ferrous metal which preferably contains iron, carbon particles in the form of graphite and can contain at least one element selected from the group consisting of silicon and phosphorous for promoting rapid dissolution of the sintered metal at a preselected temperature which is about the normal pour temperature of the molten metal being treated.

Preferably the composition of the sintered metal sheath is formulated to substantially match the composition of cast iron. For example the carbon content can be selected from the range of about 3 to 4.75% while the silicon content can be selected from the range of about 1.8 to 3.0% and the phosphorous about 0.5%. The balance of the sintered metal is iron. The iron, carbon, silicon and/or phosphorous are preferably provided in amounts sufficient for establishing the melting point of the sintered metal at a preselected temperature which is lower than the melting point of low carbon, mild steel, for example an SAE 1008 or 1010 steel, which melts at about 1545° C. The preselected temperature is preferable at about the normal pour temperature of molten iron which ranges from about 1315° C. to about 1450° C. In one example article, the sintered metal sheath contains about 4.5% carbon, about 2.8% silicon, about 0.5% phosphorous, and the balance being iron. The melting point of a sintered metal having this composition is about 1290° C.

The term "treating agent" as used herein includes the elements, compounds, alloys, etc. which actually alter the molten metal together with any trace elements, carriers or binders which may be present in or added to commercial treating materials.

The type of treating agent in the article 10 is dependent upon the base molten metal to be treated and the desired metallurgical characteristics of the resultant product. For example, for inoculating an iron to produce gray iron the treating agent can consist essentially of ferrosilicon. Two examples of such ferrosilicon treating agents are set forth below.

EXAMPLE No. 1

Silicon: 74–79%
Aluminum: 1.00–1.50%
Calcium: 0.50–1.00%
Iron: Balance

EXAMPLE NO. 2

Silicon: 60–65%
Aluminum: 0.75–1.25%
Calcium: 1.5–2.5%
Manganese: 5–7%
Zirconium: 5–7%
Barium: 2–3%
Iron: Balance Example 1 is identified as "Grade 75% ferrosilicon" and Example 2 is identified as "SMZ alloy" both of which are manufactured by Union Carbide Corporation, Ferroalloys Division, Buffalo, N.Y. The ferrosilicon used in the present article can have a silicon content between about 55% and 85% by weight of the treating agent with a silicon content of about 75% being preferred. When the silicon content is below about 55%, the treating agent is inefficient and will not inoculate the iron properly. When the silicon content is above 85% the treating agent causes an exothermic reaction and can undesirably raise the temperature of the molten iron.

As noted in the above examples, the treating agent can also contain small portions of one or more trace elements for producing a specific resultant product. Trace elements that have been found to be useful in the treating agent used in article 10 includes strontium, barium, aluminum, cerium, calcium, and rare earth alloys among others.

A third example for treating a molten iron for producing a nodular cast iron is a magnesium ferrosilicon treating agent as set forth below. The third example is also manufactured by Union Carbide Corporation.

EXAMPLE NO. 3

Magnesium: 8–10%
Silicon: 44–48%
Iron: Balance

The sintered metal strip is made by conventional methods, the difference being that the powdered elements, compounds or alloys (for example, carbon, silicon and phosphorous) which promote rapid dissolution of the sintered metal sheath at a preselected temperature are mixed with the powdered iron prior to the iron being rolled into the strip. Strips made from metal powders having the composition of cast iron have improved formability as compared to cast iron made by conventional methods, and can be readily formed into a tube or other shapes.

The method of making the composite article includes depositing a metered amount of treating agent along the length of a flat strip of sintered metal. The sintered metal strip is then rolled into a tubular sheath enclosing the treating agent. The tubular sheath is then rolled or drawn to a preselected size thereby compacting the treating agent and reducing the thickness of the sheath to the desired wall thickness. The article is then coiled onto a reel or spool for subsequent use in treating molten metal.

In view of the foregoing, it is readily apparent that the composite article of the present invention will readily melt in molten iron so as not delay the final dissolution of the composite article in the molten iron and will not unduly limit the maximum permissible feed rate of the article into the iron. This is made possible by using a sintered metal sheath having essentially the composition of the molten iron and including ingredients which promote the rapid dissolution of the sheath at the normal pour temperature of the molten iron.

Other aspects, objects and advantages of this invention can be obtained from a study of the drawings, the disclosure and the appended claims.

The embodiments of the invention in which an exclusive property or privilege is claimed are defined as follows:

1. An elongate composite article for controlled insertion into molten iron for altering same, said molten iron having a preselected temperature, comprising:

a core of particulate treating agent in a compacted condition; and a tubular sheath enclosing said core and maintaining said core in said compacted condition, said sheath being a sintered metal and wherein the sintered metal contains iron, carbon, silicon and phosphorous in amounts substantially matching the composition of cast iron.

2. An elongated composite article for controlled insertion into molten iron for altering same, said molten iron having a preselected temperature, comprising:

a core of particulate treating agent in a compacted condition; and a tubular sheath enclosing said core and maintaining said core in said compacted condition, said sheath being a sintered metal, wherein the sintered metal contains iron, carbon, and at least one element selected from the group consisting of silicon and phosphorous, said iron, carbon and said one element being in amounts sufficient for establishing the melting point of the sintered metal at about said preselected temperature, said preselected temperature being about the normal pour temperature of the molten iron.

3. The article of claim 1 wherein said sintered metal contains about 4.5% carbon, about 2.8% silicon, about 0.5% phosphorous, and the balance being iron.

4. The article of claim 3 wherein the sintered metal has a melting point of about 1290° C.

5. The article of claim 1 wherein said carbon particles are crystalline graphite.

6. The article of claim 1 wherein the treating agent consists essentially of a ferrosilicon having a silicon content of between 55% and 85% by weight of the treating agent.

7. The article of claim 6 wherein the silicon content is about 75% by weight of the treating agent.

8. The article of claim 6 wherein the treating agent has at least one trace element selected from the group consisting of strontium, barium, calcium, cerium, aluminum and rare earth alloys.

9. The article of claim 1 wherein the treating agent consists essentially of a magnesium ferrosilicon having a magnesium content of about 9% and a silicon content of about 46%.

10. In an elongate composite article for controlled insertion into molten iron at a preselected temperature for altering same, said article being of the type having a core of particulate treating agent and a tubular sheath enclosing said core, wherein the improvement comprises:

said sheath being formed from a sintered metal and the sintered metal contains iron, carbon, silicon, and phosphorus in amounts substantially matching the composition of cast iron.

* * * * *